US005579729A

United States Patent [19]

Batzill et al.

[11] Patent Number: 5,579,729

[45] Date of Patent: Dec. 3, 1996

[54] INTERNAL COMBUSTION ENGINE

[75] Inventors: Manfred Batzill, Neuhausen; Hans-Joachim Esch, Heimsheim; Winfried Distelrath, Stuttgart, all of Germany

[73] Assignee: Dr. Ing. h.c.F. Porsche AG, Weissach, Germany

[21] Appl. No.: 391,686

[22] Filed: Feb. 21, 1995

[30] Foreign Application Priority Data

Feb. 18, 1994 [DE] Germany ..... 44 05 188.3

[51] Int. Cl.[6] ..... F02F 7/00; F01M 11/02; F01M 5/00; F02B 75/24

[52] U.S. Cl. ..... 123/55.5; 123/196 R

[58] Field of Search ..... 123/55.5, 55.7, 123/196 R

[56] References Cited

U.S. PATENT DOCUMENTS

| | | | |
|---|---|---|---|
| 1,254,281 | 1/1918 | Salway | 123/55.5 |
| 2,106,939 | 2/1938 | Wilcken | 123/55.5 |
| 2,969,781 | 1/1961 | Kolbe . | |
| 3,059,623 | 10/1962 | Booth et al. . | |
| 3,568,649 | 3/1971 | Syson et al. . | |
| 4,393,824 | 7/1983 | Fischer et al. | 123/196 R |
| 4,426,965 | 1/1984 | Patel | 123/196 R |

FOREIGN PATENT DOCUMENTS

| | | |
|---|---|---|
| 020120 | 10/1987 | European Pat. Off. . |
| 0240120 | 10/1987 | European Pat. Off. . |
| 1423850 | 11/1965 | France . |
| 1149198 | 10/1959 | Germany . |

OTHER PUBLICATIONS

European Search Report, May 19, 1995, Europe.

*Primary Examiner*—Marguerite McMahon
*Attorney, Agent, or Firm*—Evenson McKeown Edwards & Lenahan

[57] ABSTRACT

An opposed-cylinder internal-combustion engine, includes a cylinder block and crankcase which is longitudinally divided in the center of the crankshaft bearing. A bearing support is connected with the crankcase by way of cylinder head bolts. The cylinder block and crankcase has a joint vertical junction plane with the bearing support. Both bearing support halves are, on the one hand, connected with one another by way of bearing block screws and, on the other hand, the bearing support is held by way lo of cylinder head bolts between the crankcase halves arranged at both sides of the bearing support while forming oil ducts. At the same time, cylinder heads can be fastened on the crankcase by way of the screws.

32 Claims, 4 Drawing Sheets

INTERNAL COMBUSTION ENGINE

BACKGROUND AND SUMMARY OF THE INVENTION

This invention relates to an internal-combustion engine, particularly to an opposed-cylinder engine, comprising a cylinder block and crankcase divided longitudinally in the center of the crankshaft bearing and a bearing support connected by cylinder head bolts with the crankcase.

From German Patent DE-AS 11 49 198, a crankcase for an internal-combustion engine is known in the case of which one bearing support half is part of the case and the other bearing support half is fixed by way of fastening screws. The case halves are connected with one another by way of continuous cylinder head bolts.

Also, from U.S. Pat. No. 2,969,781, a crankcase is known which is connected with the bearing support by way of common screws.

It is an object of the invention to provide an internal-combustion engine, particularly an opposed-cylinder engine, which has a simple assembly, permits a construction by means of different materials and ensures an optimal oil feeding to both bearing points of the crankshaft.

According to the invention, this object is achieved by providing an opposed-cylinder internal-combustion engine, comprising a cylinder block, a crankcase which is longitudinally divided in the center of a crankshaft bearing, and a bearing support which is connected with the crankcase by way of cylinder head bolts, wherein the cylinder block and crankcase have a common vertical junction plane with the bearing support, wherein bearing support halves are connected with one another by way of bearing block screws, wherein the bearing support is held by way of cylinder head bolts between crankcase halves arranged on both sides of the bearing support while forming oil ducts along bores in the crankcase halves for the cylinder head bolts, wherein cylinder heads are also fastened on the respective crankcase halves by the cylinder head bolts.

By means of the invention, it is achieved that the bearing support may consist of a different material than the cylinder block and crankcase and an assembly takes place which is detached from the crankcase. This becomes possible by a fastening of the bearing support in the crankcase by way of cylinder head bolts which are arranged separately from the bearing block screws.

Receiving devices for assemblies, such as a starter, etc. are cast onto the crankcase. Likewise, cooling ducts are integrated into the case. Furthermore, the two case halves have walls for forming an oil space in which an oil collector with passage openings to the oil plan is arranged on the case halves.

In the connecting surfaces of the cylinder block and crankcase directed to the bearing support, oil ducts are sunk in which are covered by the plane connecting surface of the bearing support. The oil circulation extends by way of the oil ducts in the cylinder block and crankcase, through transverse bores and diagonal bores in the bearing support, to the bearing points of the crankshaft. By way of several bores of the cylinder head bolts, a feeding of oil takes place into the cylinder head which has corresponding diagonal ducts for this purpose.

The junction plane of the cylinder block and crankcase is situated in the same junction plane as the bearing support and extends through the center of the crankshaft bearing. As a result, a symmetrical crankcase is obtained with the respective cylinder heads.

Other objects, advantages and novel features of the present invention will become apparent from the following detailed description of the invention when considered in conjunction with the accompanying drawings.

DETAILED DESCRIPTION OF THE DRAWINGS

An internal-combustion engine, particularly an opposed-cylinder engine, comprises essentially a crankcase 1 in which a bearing support 2 is held. The respective cylinder heads 3 and are connected with the crankcase 1. The crankcase consists, for example, of an aluminum material, and the bearing support consists, for example, of a gray cast iron.

The cylinder block and crankcase 1 consists of case halves 5 and 6 which have a junction plane a—a which coincides with the junction plane b—b of the bearing support 2.

Figure 1:
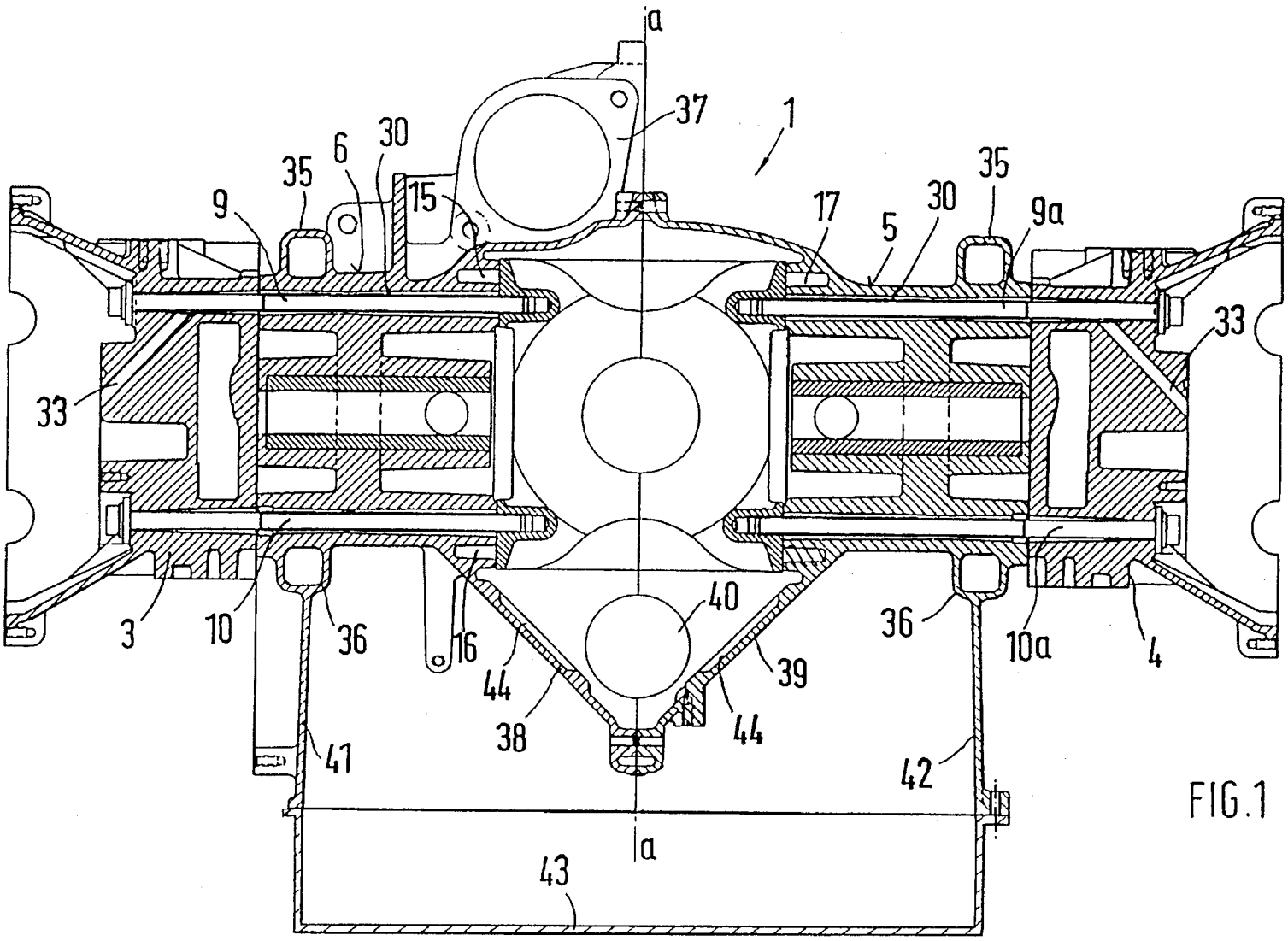
FIG. 1 is a cross-sectional view of a cylinder block and crankcase with a bearing support and cylinder heads in the area of the cylinder head bolts, constructed according to a preferred embodiment of the invention.
Figure 2:
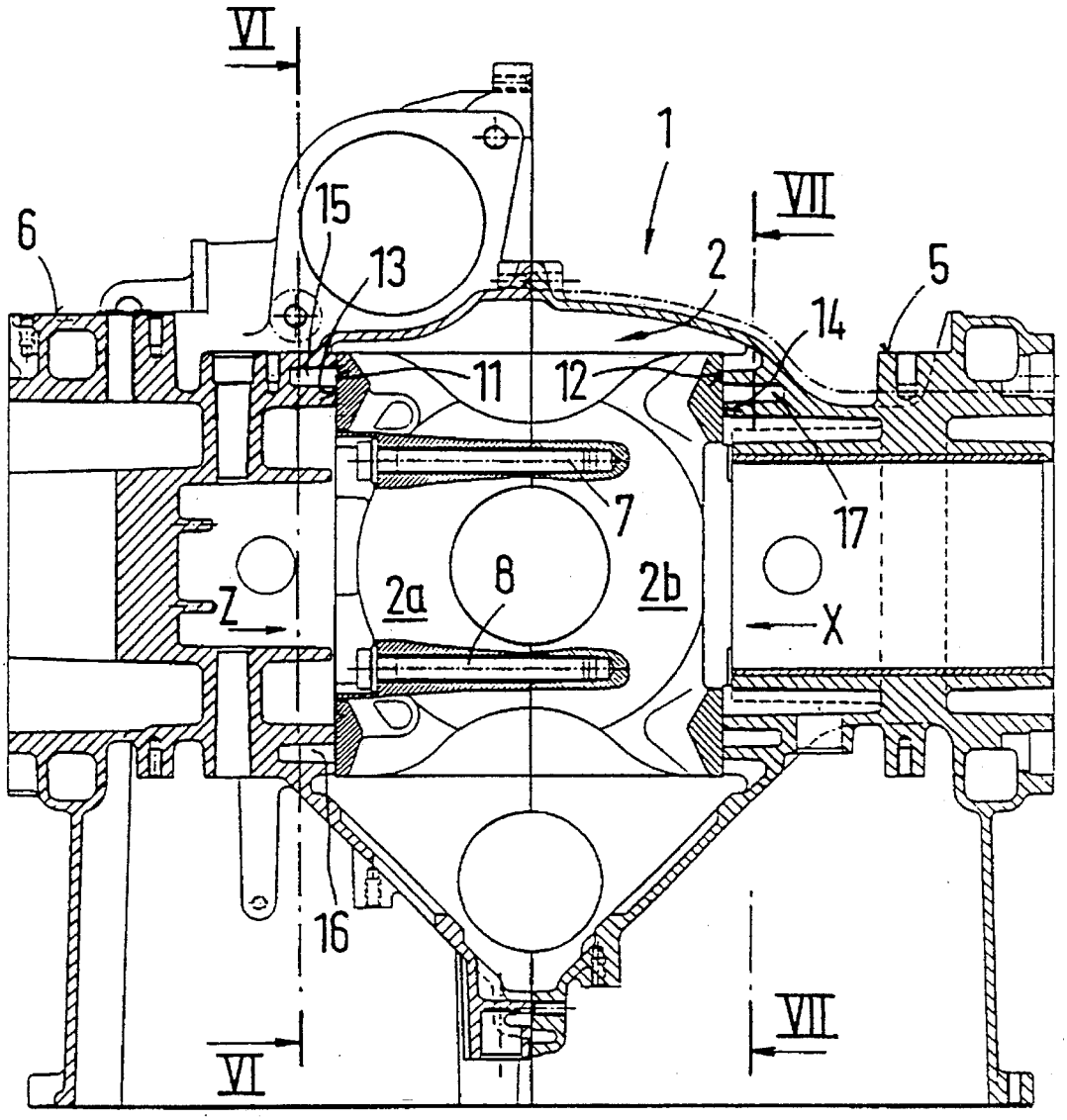
FIG. 2 is a cross-sectional view according to FIG. 1 in the area of the cylinder bores.
Figure 3:
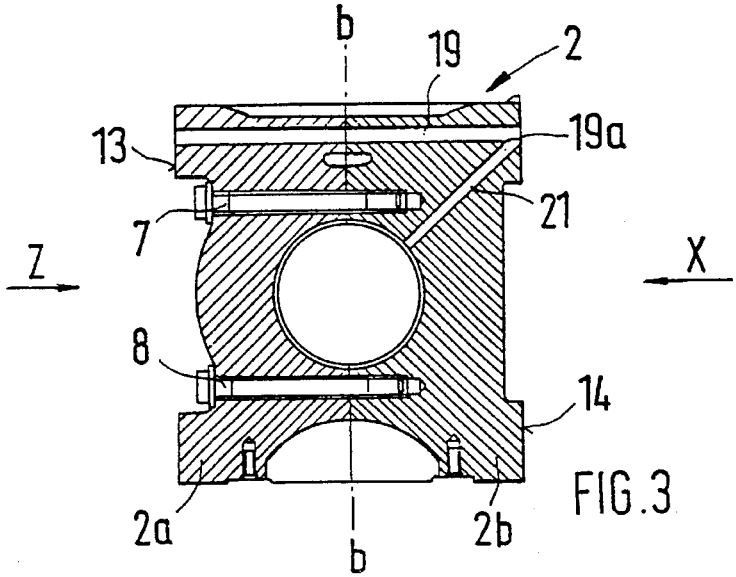
FIG. 3 is a sectional view of the bearing support taken along line III—III of FIG. 7.
Figure 4:
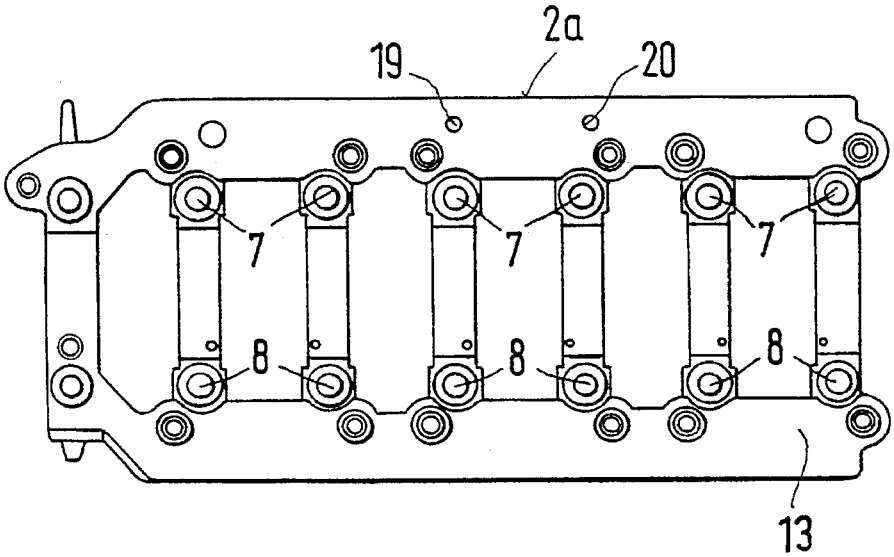
FIG. 4 is a view in the direction of the arrow Z of FIG. 3 of a contact surface of the bearing support.

The two halves 2*a*, 2*b* of the bearing support 2 are connected with one another by way of bearing block screws 7,8 which are arranged in the same direction (from left to right as shown in FIG. 2).

Each case halve 5, 6 of the crankcase 1 is braced with the bearing support 2 by way of cylinder head bolts 9, 10; 9*a*, 10*a*, in which case the bolts 9, 10 and 9*a*, 10*a* each also fix the cylinder head, 3, 4 to the crankcase 1. The cylinder head bolts 9, 10 are arranged in the opposite direction of the other cylinder head bolts 9*a*, 10*a* and in each case are based on the end side in a receiving bore of the bearing support 2.

In the contact surface 11 and 12 of each crankcase half 6 and 5, which are opposite the plane surfaces 13, 14 of the bearing support halves 2*a*, 2*b*, the oil ducts 15, 16 and 17 are sunk in. These are covered by the opposite plane contact surfaces 13 and 14 so that respective closed oil ducts are formed.

Figure 5:
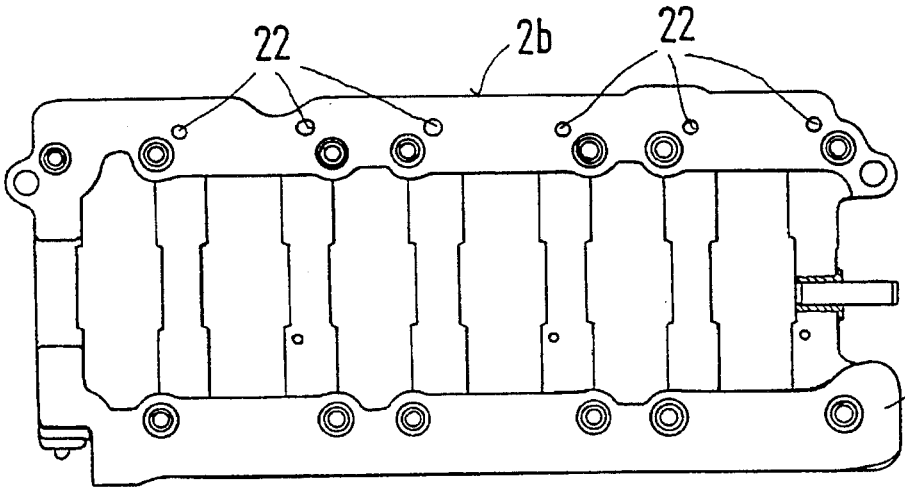
FIG. 5 is a view in the direction of the arrow X of FIG. 3 of the other contact surface of the bearing support.

The oil ducts 15 and 16 are connected with one another by way of a first case-side duct 18, and the oil duct 15 of one case half 6 is connected with the oil duct 17 of the other case half 5 by way of at least two transverse ducts 19 and 20 in the bearing support 2. Diagonal ducts 21 in the bearing support 2 branch off these ducts 19, 20 as well as off the duct 17, which diagonal ducts 21 lead to the bearing sites 22 of the crankshaft. The inlet opening 22 of the diagonal ducts 21 is shown in detail in FIG. 5. The diagonal ducts 21 may preferably have the same oil inlet duct 19*a* as the two transverse ducts 19, 20. Advantageously, the inlet openings of the ducts 19, 21 and 20, 21 are separate.

At reference number 23, the oil duct 16 has an inflow which is connected with an oil pump 24. By way of an interposed oil filter 25 in duct 16, the oil flows through the case-side duct 18 to the oil duct 15. Before entering this duct 15, the oil flows through an oil/water heat exchanger 26.

The cylinder head bolts 9, 10 and 9*a*, 10*a* are arranged in bores 30 of the crankcase 1 as well as of the heads 4 and 5 which at the same time form oil passages. For this purpose, they have a larger diameter than the screws. Connecting ducts 31 into the oil duct 15 branch off these bores. Likewise, in the second case half 6, connecting ducts 32 of the bores of the bolts 9, 10 into the oil duct 17 are provided. As a result, the oil can flow from the oil ducts 15 and 17 to each head side 4, 5 through the bores of the cylinder head bolts 9, 9*a* and 10, 10*a*, for the purpose of which one diagonal duct 33 respectively branches off the bores which is arranged in the head.

Figure 6:
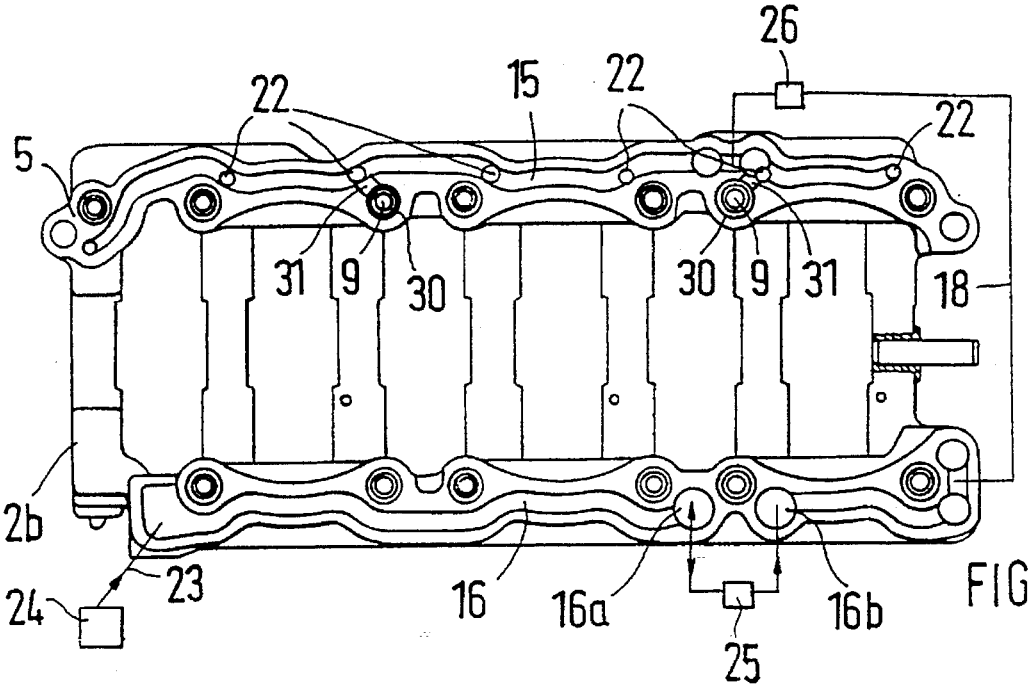
FIG. 6 is a view of the oil ducts in the crankcase in the direction of arrow X in the intersecting plane VI—VI according to FIG. 2.
Figure 7:
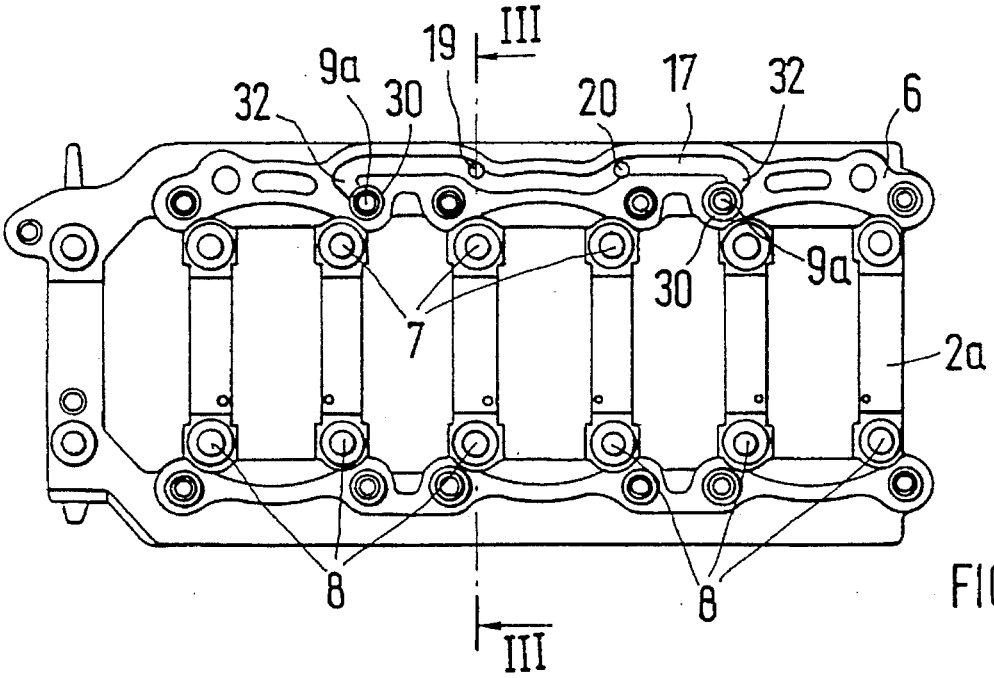
FIG. 7 is a view of the oil ducts in the crankcase in the direction of the arrow Z in the intersecting plane VII—VII of FIG. 2.

As illustrated in detail particularly in FIGS. 6 and 7, the oil ducts 15, 16 and 17 extend almost along the whole length of the crankcase 1, in which case the oil ducts 15, 16 are arranged in the crankcase halves 5 on both longitudinal sides, and the oil duct 17 is arranged on case half 6 only on one longitudinal side.

Each half 5, 6 of the cylinder block and crankcase 1 has at least opposite cast-on cooling ducts 35, 36. Between the cooling ducts 35 of one crankcase side, a starter receiving device 37 is provided which is assigned to case half 6 and ends with the junction plane a—a.

Opposite, on the other crankcase side, two walls 38, 39 of an oil collector, which extend in the shape of a funnel, are cast on symmetrically with respect to the junction plane a—a integrated into the case halves 5, 6. Inside this oil collector, an idler shaft 40 is situated. This oil collector is arranged between walls 41, 42 which branch off cooling ducts 36. The space formed by the walls 41, 42 is closed off my means of a cover 43 and forms an oil pan. Oil passage openings 44 are provided in the walls 41, 42.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opposed-cylinder internal combustion engine comprising:

a pair of cylinder blocks, a crankcase which is longitudinally divided into two crankcase halves in a center of a crankshaft bearing, and a bearing support which is connected with the crankcase by way of cylinder head bolts through the respective cylinder heads, wherein the cylinder blocks and crankcase have a common junction plane with the bearing support, wherein the bearing support includes bearing support halve independently connected with one another by way of bearing block screws, wherein the bearing support is held by the cylinder head bolts between the crankcase halves which are arranged on both sides of the bearing support, said crankcase halves including while forming oil acts communicating with bores in the crankcase halves for the cylinder head bolts, wherein cylinder heads are also fastened on the respective crankcase halves by the cylinder head bolts, and wherein the oil ducts are arranged only in surfaces of the cylinder block and crankcase and are each closed off by an opposite contact surface of the bearing support.

2. An engine according to claim 1, wherein the oil duct of one longitudinal side in one crankcase half is connected with an oil pump, and an oil filter is arranged between an inflow and outflow bore of the duct, and wherein an oil/water heat exchanger is provided between this oil duct and the other oil duct on the other longitudinal side of the one crankcase half.

3. An opposed-cylinder internal combustion engine comprising:

a pair of cylinder blocks, a crankcase which is longitudinally divided into two crankcase halves in a center of a crankshaft bearing, and a bearing support which is connected with the crankcase by way of cylinder head bolts through the respective cylinder heads, wherein the cylinder blocks and crankcase have a common junction plane with the bearing support, wherein the bearing support includes bearing support halves independently connected with one another by way of bearing block screws, wherein the bearing support is held by the cylinder head bolts between the crankcase halves which are arranged on both sides of the bearing support, said crankcase halves including oil ducts communicating with bores in the crankcase halves for the cylinder head bolts, wherein cylinder heads are also fastened on the respective crankcase halves by the cylinder head bolts, wherein the oil are arranged only in surfaces of the cylinder block and crankcase and are each closed off by an opposite contact surface of the bearing support, and wherein opposite oil ducts of the crankcase halves are connected to diagonal and transverse ducts on the bearing support.

4. An engine according to claim 3, wherein the oil ducts are arranged only in surfaces of the cylinder block and crankcase and are each closed off by an opposite contact surface of the bearing support.

5. An engine opposed-cylinder internal combustion comprising:

a pair of cylinder blocks, a crankcase which is longitudinally divided into two crankcase halves in a center of a crankshaft bearing, and a bearing support which is connected with the crankcase by way of cylinder head bolts through the respective cylinder heads, wherein the cylinder blocks and crankcase have a common junction plane with the bearing support, wherein the bearing support includes bearing support halves independently connected with one another by way of bearing block screws, wherein the bearing support is held by the cylinder head bolts between the crankcase halves which are arranged on both sides of the bearing support, said crankcase halves including oil ducts communicating with bores in the crankcase halves for the cylinder head bolts, wherein cylinder heads are also fastened on the respective crankcase halves by the cylinder head bolts, and wherein at least one transverse duct is provided above the crankshaft bearing which, by means of diagonal ducts extending to bearing points, in each case leads out into an oil duct on a longitudinal side.

6. An engine according to claim 5, wherein the oil ducts are arranged only in surfaces of the cylinder block and crankcase and are each closed off by an opposite contact surface of the bearing support.

7. An engine according to claim 5, wherein the oil ducts in the cylinder block and crankcase extend approximately along the whole length at both longitudinal sides of each crank case half, and the ducts are connected with one another by way of at least one crankcase transverse duct, and wherein opposite oil ducts of the crankcase halves are connected to diagonal and transverse ducts on the bearing support.

8. An opposed-cylinder internal combustion engine comprising:

a pair of cylinder blocks, a crankcase which is longitudinally divided into two crankcase halves in a center of a crankshaft bearing, and a bearing support which is connected with the crankcase by way of cylinder head bolts through the respective cylinder heads, wherein the cylinder blocks and crankcase have a common junction plane with the bearing support, wherein the bearing support includes bearing support halves independently connected with one another by way of bearing block screws, wherein the bearing support is held by the cylinder head bolts between the crankcase halves which are arranged on both sides of the bearing support, said crankcase halves including oil ducts communicating with bores in the crankcase halves for the cylinder head bolts, wherein cylinder heads are also fastened on the respective crankcase halves by the cylinder head bolts, and opposed-cylinder internal combustion, and wherein one case half has an oil duct on both longitudinal sides respectively, the other crankcase half having an oil duct only on one longitudinal side, the transverse ducts of the bearing support leading into this oil duct of the other crankcase half.

9. An engine according to claim 8, wherein the oil ducts in the cylinder block and crankcase extend approximately along the whole length at both longitudinal sides of each crank case half, and the ducts are connected with one another by way of at least one crankcase transverse duct, and wherein opposite oil ducts of the crankcase halves are connected to diagonal and transverse ducts on the bearing support.

10. An opposed-cylinder internal combustion engine, comprising:

first and second bearing support halves abutting one another along a junction plane, a first cylinder block disposed on a surface of the first bearing support half at a side of said first bearing support half opposite said junction plane, a second cylinder block disposed on a surface of the second bearing support half at a side of said second bearing support half opposite said junction plane, a first cylinder head disposed on said first cylinder block on a surface of the first cylinder block facing away from the first bearing support half, a second cylinder head disposed on said second cylinder block on a surface of the second cylinder block facing away from the second bearing support half, a first set of cylinder head bolts which clamp the first cylinder head and first cylinder block to said first bearing support half, said first set of cylinder head bolts extending through the first cylinder head and the first cylinder block and terminating in said first cylinder block half, a second set of cylinder head bolts which clamp the second cylinder head and second cylinder block to said second bearing support half, said second set of cylinder head bolts extending through the second cylinder head and the second cylinder block and terminating in said second cylinder block half, and bearing support bolts connecting the bearing support halves together independently of said cylinder blocks and said cylinder heads.

11. An engine according to claim 10, wherein said bearing support halves are constructed of a first material, and wherein said cylinder blocks are constructed of a second material which is different than the first material.

12. An engine according to claim 11, wherein said first material is gray cast iron, and wherein said second material is an aluminum material.

13. An engine according to claim 10, comprising a first crankcase part formed integrally with the first cylinder block and a second crankcase part formed integrally with the second cylinder block, said first and second crankcase parts being connected together along said junction plane.

14. An engine according to claim 10, wherein said cylinder head bolts extend through respective through holes in the respective cylinder blocks, said through holes forming oil ducts along said cylinder head bolts.

15. An engine according to claim 14, wherein said cylinder head bolts extend through respective cylinder head bolt holes, a portion of said cylinder head bolt holes adjacent respective adjoining cylinder blocks being configured as continuations of the oil ducts formed in the through holes in the cylinder blocks, and wherein diagonal oil passages through the cylinder heads connect with the respective oil duct continuations of the cylinder head bolt holes.

16. An engine according to claim 10, wherein the bearing support bolts all extend in the same direction in the bearing support halves and include a bolt head clampingly engaging the first bearing support half and a threaded section anchored in the second bearing support half.

17. An engine according to claim 10, wherein each of said cylinder head bolts of said first set includes a bolt head clampingly engaging the first cylinder head and a threaded end section anchored in the first bearing support half, and wherein each of said cylinder head bolts of said second set includes a bolt head clampingly engaging the second cylinder head and a threaded end section anchored in the second bearing support half.

18. An engine according to claim 16, wherein each of said cylinder head bolts of said first set includes a bolt head clampingly engaging the first cylinder head and a threaded end section anchored in the first bearing support half, and wherein each of said cylinder head bolts of said second set includes a bolt head clampingly engaging the second cylinder head and a threaded end section anchored in the second bearing support half.

19. An engine according to claim 10, wherein the cylinder head bolts are partially arranged in respective bores of the cylinder heads and cylinder blocks which also form oil passages extending between oil passage means in a respective cylinder head and oil passage means in a respective bearing support half.

20. An engine according to claim 19, wherein the oil passage means include passages arranged in surfaces of the respective cylinder blocks which are each closed off by an opposite contact surface of an associated bearing support half.

21. An engine according to claim 10, wherein each of said cylinder blocks contain a plurality of cylinders arranged longitudinally spaced adjacent one another and facing said junction plane, and wherein said cylinder head bolts extend through respective through holes in the respective cylinder blocks, said through holes forming oil ducts along said cylinder head bolts.

22. An engine according to claim 21, comprising oil passages formed in each of said cylinder blocks at surfaces thereof which face the respective adjacent bearing support halves.

23. An engine according to claim 22, wherein said oil passages include longitudinal oil passages which extend substantially along the longitudinal length of the cylinder blocks along the respective cylinders thereof, said longitudinal oil passages communicating with said oil ducts and with respective oil passages in said bearing support halves.

24. An engine according to claim 23, wherein said longitudinal oil passages at one longitudinal side of the longitudinal length of the cylinder blocks are connected to one another by way of at least one transverse duct.

25. An engine according to claim 24, wherein diagonally extending transverse ducts are provided in each of said bearing support halves for each pair of cylinders for communicating bearing points with said longitudinal oil passages.

26. An engine according to claim 25, wherein the longitudinal oil passage of one longitudinal side of one cylinder block is connected with an oil pump, and an oil filter is arranged between an inflow and outflow bore of said last mentioned longitudinal oil passage, and wherein an oil/water heat exchanger is provided between this last mentioned longitudinal oil passage and the other longitudinal oil passage on the other longitudinal side of the one cylinder block.

27. An engine according to claim 23, wherein one cylinder block has a longitudinal oil passage on both longitudinal sides respectively, the other cylinder block having a longitudinal oil passage only on one longitudinal side, transverse ducts of one of the bearing support halves leading into this oil duct of the other cylinder block.

28. An engine according to claim 13, wherein the cylinder blocks and crankcase parts have mutually opposite integrally formed cooling ducts and a starter receiving device.

29. An engine according to claim 28, wherein walls which extend in a funnel shape and meet in the junction plane are provided between two cooling ducts of associated crankcase parts, between which walls and an idler shaft is disposed.

30. An engine according to claim 29, wherein walls are provided which branch off the cooling ducts forming an oil pan.

31. An engine according to claim 13, wherein the cylinder head bolts are partially arranged in respective bores of the cylinder heads and cylinder blocks which also form oil passages extending between oil passage means in a respective cylinder head and oil passage means in a respective bearing support half.

32. An engine according to claim 31, wherein the oil passage means include passages arranged in surfaces of the respective cylinder blocks which are each closed off by an opposite contact surface of an associated bearing support half.

* * * * *